United States Patent [19]

Wheeler

[11] Patent Number: 4,903,036

[45] Date of Patent: Feb. 20, 1990

[54] VLF COMMUNICATION SYSTEM

[75] Inventor: Myron S. Wheeler, Catorsville, Md.

[73] Assignee: Westinghouse Electric Corp., Pittsburgh, Pa.

[21] Appl. No.: 288,386

[22] Filed: Dec. 22, 1988

[51] Int. Cl.[4] ..... H01Q 1/28

[52] U.S. Cl. ..... 343/706; 343/848; 343/849

[58] Field of Search ..... 343/706, 848, 849, 719

[56] References Cited

U.S. PATENT DOCUMENTS

| | | | |
|---|---|---|---|
| 1,296,687 | 3/1919 | Nichols | 343/706 |
| 1,320,142 | 10/1919 | Hanson | 343/706 |
| 1,650,461 | 11/1927 | Nilson | 343/706 |
| 2,433,344 | 12/1947 | Crosby | 343/706 |
| 3,253,279 | 5/1966 | Tanner | 343/849 |
| 3,727,229 | 4/1973 | Clinger et al. | 343/706 |
| 4,476,576 | 10/1984 | Wheeler et al. | 343/706 |

*Primary Examiner*—Rolf Hille
*Assistant Examiner*—Hoanganh Le
*Attorney, Agent, or Firm*—D. Schron

[57] ABSTRACT

A VLF communication system which utilizes the tether of an aerostat system as the VLF antenna. The aerostat is flown at an altitude such that the tether is approximately a quarter wavelength of the operating frequency and the transmitter signal is coupled to the antenna by means of a elongated sleeve transformer surrounding the tether and including a single turn primary coupled to the transmitter with the tether acting as a single turn secondary of the transformer.

7 Claims, 5 Drawing Sheets

FIG. 5.

VLF COMMUNICATION SYSTEM

BACKGROUND OF THE INVENTION

1. Field of the Invention

The invention in general relates to the transmission of very low frequencies and particularly to an arrangement which utilizes an aerostat tether for the antenna of the communication system.

2. Background Information

For military or civil emergency situations, a need exists for a relatively small, portable VLF communication system which may be transported to a site and quickly placed into operation. In view of the relatively long antenna structure required for a VLF communication system, it becomes impractical to transport a tower structure which may be thousands of feet long. Accordingly, proposals have been made for using the tether of an aerostat system as the VLF antenna. In this manner, the aerostat may be deployed to an operational altitude measured in thousands of feet, when in a deployed condition, while in a transportable condition, the tether may be wound upon a winch and the aerostat itself may be in a deflated condition.

One such system is described in U.S. Pat. No. 4,476,576 which illustrates an aerostat tether wound upon a winch mechanism with the conductors of the tether being connected to a slip ring assembly. An intelligence signal to be transmitted is coupled to the slip ring assembly via an antenna tuner and a transformer. In view of the fact that the arrangement applies a very high voltage to the winch mechanism, a requirement existed for complete electrical isolation of the winch mechanism from a carrier vehicle so as to obviate a potentially dangerous situation. It is more desirable to completely eliminate any potential hazard to operating personnel.

In another system actually used by the assignee of the present invention, a mooring system was utilized and included a horizontally movable boom having at the end thereof a pulley or sheave member and the tether for the aerostat passed from the winch mechanism on a carrier structure, through the boom and around the sheave to the deployed aerostat. The tether included a dual concentric metallic braiding and an electrical connection from the transmitter was made to the braiding. Such electrical connection however required an objectionable stripping operation of the braiding and in addition, the apparatus utilized an objectionably large and costly inductor for tuning purposes.

The present invention provides a VLF communication system utilizing a tether of an aerostat and eliminates the objectionable features of the previous tethered aerostat systems.

SUMMARY OF THE INVENTION

A VLF communication system is provided which includes a VLF transmitter and an aerostat connected to a ground based aerostat deployment/retrieval mooring system by means of an electromechanical tether. During operation, the aerostat is deployed to a certain altitude such that the length of the tether is approximately a quarter wavelength of the operating frequency of the transmitter. An elongated sleeve transformer having a longitudinal central aperture is provided and includes at least a one turn primary winding which passes through the central aperture. The tether, which also passes through the central aperture constitutes a secondary winding of the transformer. Means are provided for coupling the primary winding to the transmitter such that a VLF signal to be transmitted is transformer coupled to the electrical portion of the tether which then operates as an antenna to radiate the signal.

In one embodiment, the mooring system includes a horizontal boom which is rotatable to accommodate for aerostat movement and deployed at the end of the boom is a sheave around which the tether passes. The sleeve transformer may be supported just above the sheave by means of a support connected to the sheave or alternatively the transformer may be disposed before the sheave and supported in the boom structure.

BRIEF DESCRIPTION OF THE PREFERRED EMBODIMENTS

Figure 1:
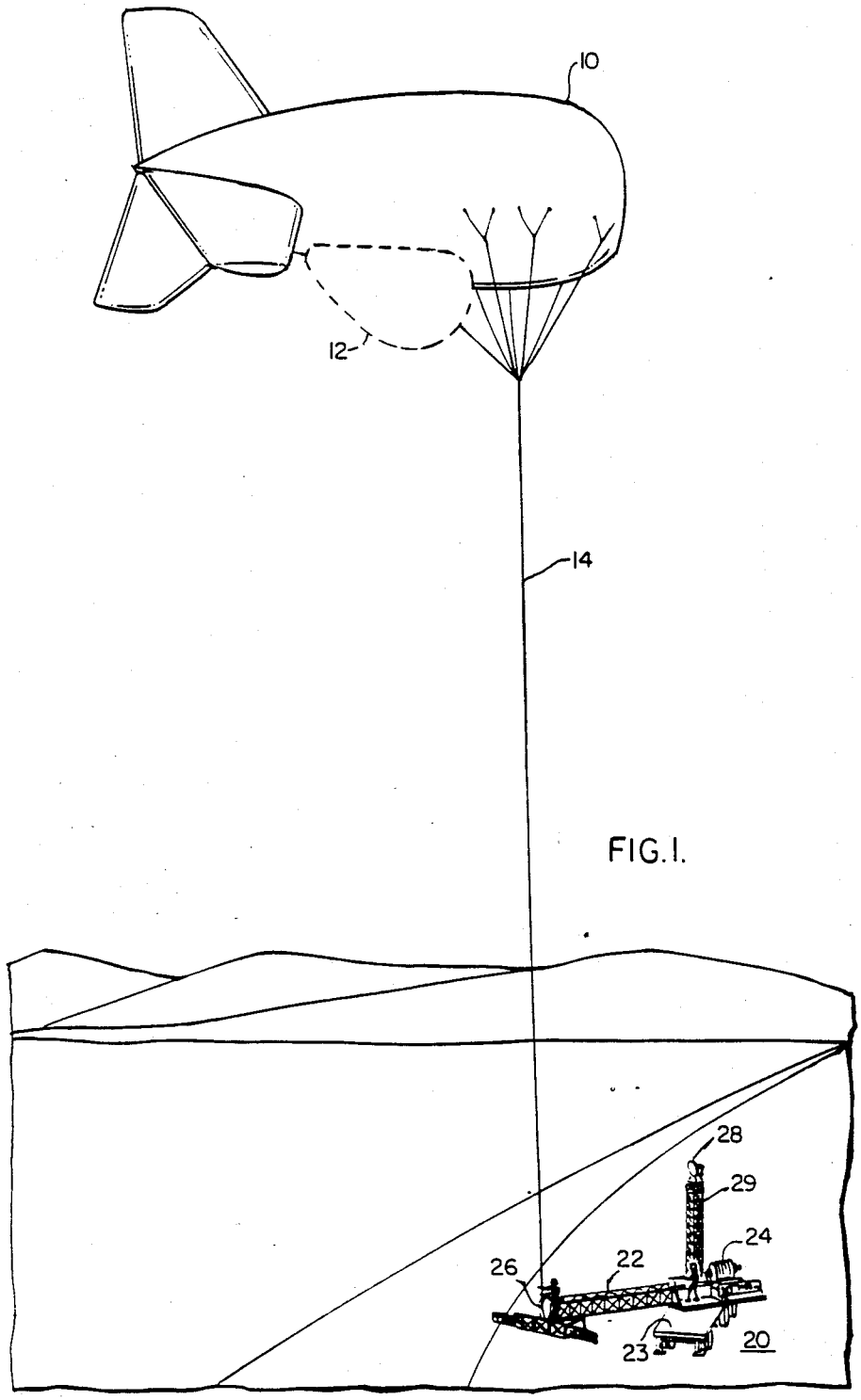
FIG. 1 is a view of an aerostat in a deployed condition connected to a ground mooring system.

A typical aerostat system is illustrated in FIG. 1 and includes an aerostat 10 which normally may carry electronic equipment which may be utilized for various operations. These operations include radar surveillance, communications, over-the-horizon relays, rural telephone and emergency broadcast applications, with the particular equipment being housed within an aerodynamically shaped windscreen 12, shown dotted. In the present invention, however, the aerostat is used to deploy an electromechanical tether 14 which is connected to a ground based aerostat deployment/retrieval mooring system 20, with the tether 14 being operational as antenna for a VLF communication system, as will be described.

The mooring system 20 includes an elongated boom 22 which is rotatable about a base structure 23 and which carries a main winch 24 upon which the tether 14 is wound. The tether passes from the winch 24 through the boom 22 and around a grooved pulley 26, generally known as a flying sheave, located at the end of the boom and rotatable about the boom axis so that the sheave 26 and tether 14 are always in the same plane. When on the ground, the aerostat 10 is attached to the mooring system 20 through mooring lines (not illustrated) and a nose cone on the aerostat mates with a nose latch assembly 28 at the top of tower 29, also carried by boom 22.

Figure 2:
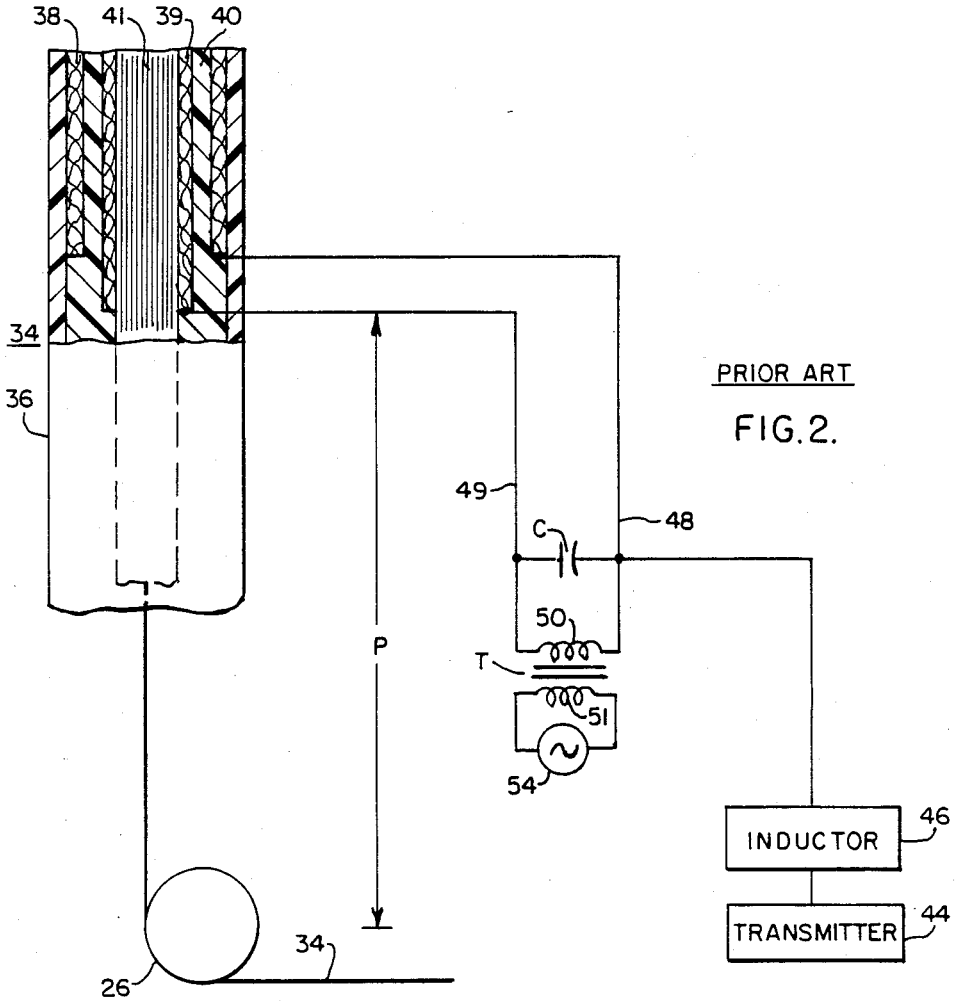
PRIOR ART FIG. 2.
FIG. 2 illustrates a previously-used VLF communication system incorporating a tethered aerostat.

FIG. 2 serves to illustrate a VLF communication system which has been in operation utilizing the apparatus of FIG. 1. The electromechanical tether actually used in the system is given the reference numeral 34 and is seen to include an outer protective jacket 36 which surrounds coaxial metallic braid conductors 38 and 39 separated by electrical insulation 40 and forming the electrical portion of the electromechanical tether. The mechanical portion is provided by means of strength members 41 which are constituted by high strength aramid fibers, one example being known by the brand name Kevlar sold by the DuPont Corporation.

The VLF transmitter 44 is coupled to the conductors 38 and 39 by means of an inductor 46 electrically connected to conductor 48 and to conductor 49 via a coupling capacitor C. Conductors 48 and 49, connected to respective metallic braids 38 and 39, terminate at the end of a secondary winding 50 of transformer T, the primary winding 51 of which is connected to a voltage source 54. This arrangement provides power to the aerostat to maintain certain housekeeping functions such as operation of beacon lights and fans for maintaining the aerodynamic shape of the aerostat.

In the operation of the apparatus of FIG. 2, the aerostat was deployed to a relatively low altitude of approximately 1/1Oth of the wavelength of the operating frequency. For such operation, a massive inductor 46 is required for tuning purposes and an operating voltage measured in tens of kilovolts is required to drive the antenna. In view of the high operating voltage, there must be sufficient insulation between the tether 34 and the metallic sheave 26 to prevent arcing and accordingly, it is necessary to first remove a section of the outer protective jacket 36 so as to gain entry to the tether for removal of the metallic braided conductors 38 and 39 over a distance P, for electrical insulative purposes. Thereafter, the protective jacket 36 must be replaced to prevent water entry and possible damage to the tether.

Although the system of FIG. 2 performs well for its intended function, under certain operational circumstances, it would be desirable to eliminate the need for removing a portion of the outer jacket, removing a section of the outer metallic braid 38, and a section of the inner braid 39 and thereafter replacing the outer jacket.

In addition, the inductor 46 utilized in the system represents a significant cost and typical inductors for such purpose may occupy a volume of over 250 cubic feet. Further, the aerostat system illustrated in FIG. 1 is normally used as a high altitude platform for carrying payloads to perform communication and surveillance functions, by way of example. The tether 34 illustrated in FIG. 2 is not the tether normally provided for such operations. The typical tether normally used is illustrated in FIG. 3.

Figure 3:
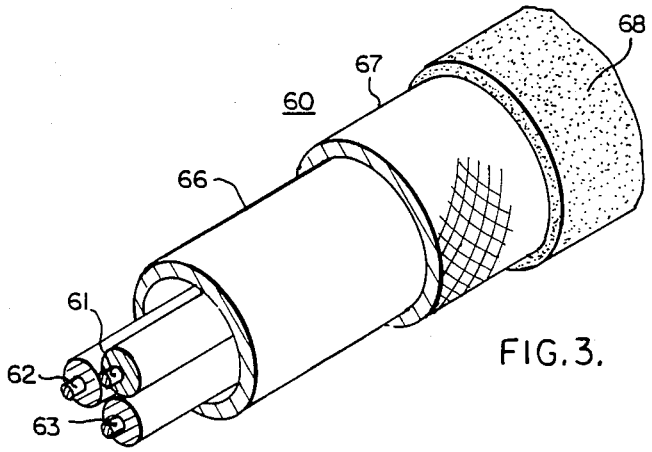
FIG. 3 illustrates one type of electromechanical tether which may be utilized in the present invention.

The electromechanical tether 60 of FIG. 3 includes three inner conductors 61, 62 and 63 each embedded in an insulator such as polyolefin thermal plastic polymer and collectively surrounded by a strength member 66 such as contrahelically wound filaments of Kevlar. A copper or aluminum braid shield 67 surrounds the strength member 66 and it in turn is surrounded by a protective jacket 68 which is preferably of a conductive or semi-conductive polymer material. Since tether 60 is available for normal aerostat operations, it would be desirable to be able to use such tether for a VLF communication system. The referenced patent uses this identical tether, however, in a system which requires slip rings and the physical and electrical isolation of the winch utilized for tether storage.

Figure 4A:
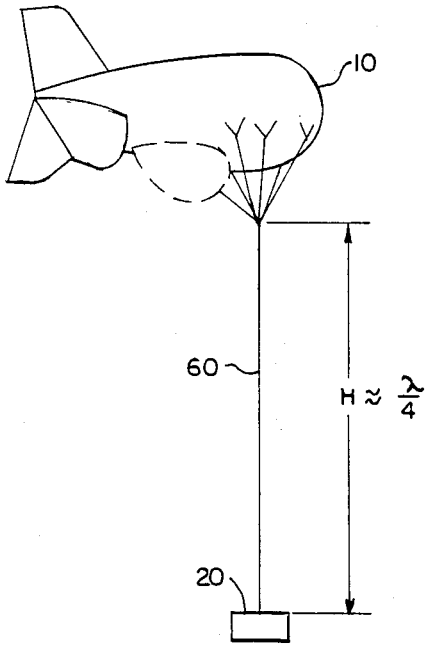
FIG. 4A is a diagram illustrating the length of the tether during operation.
Figure 4:
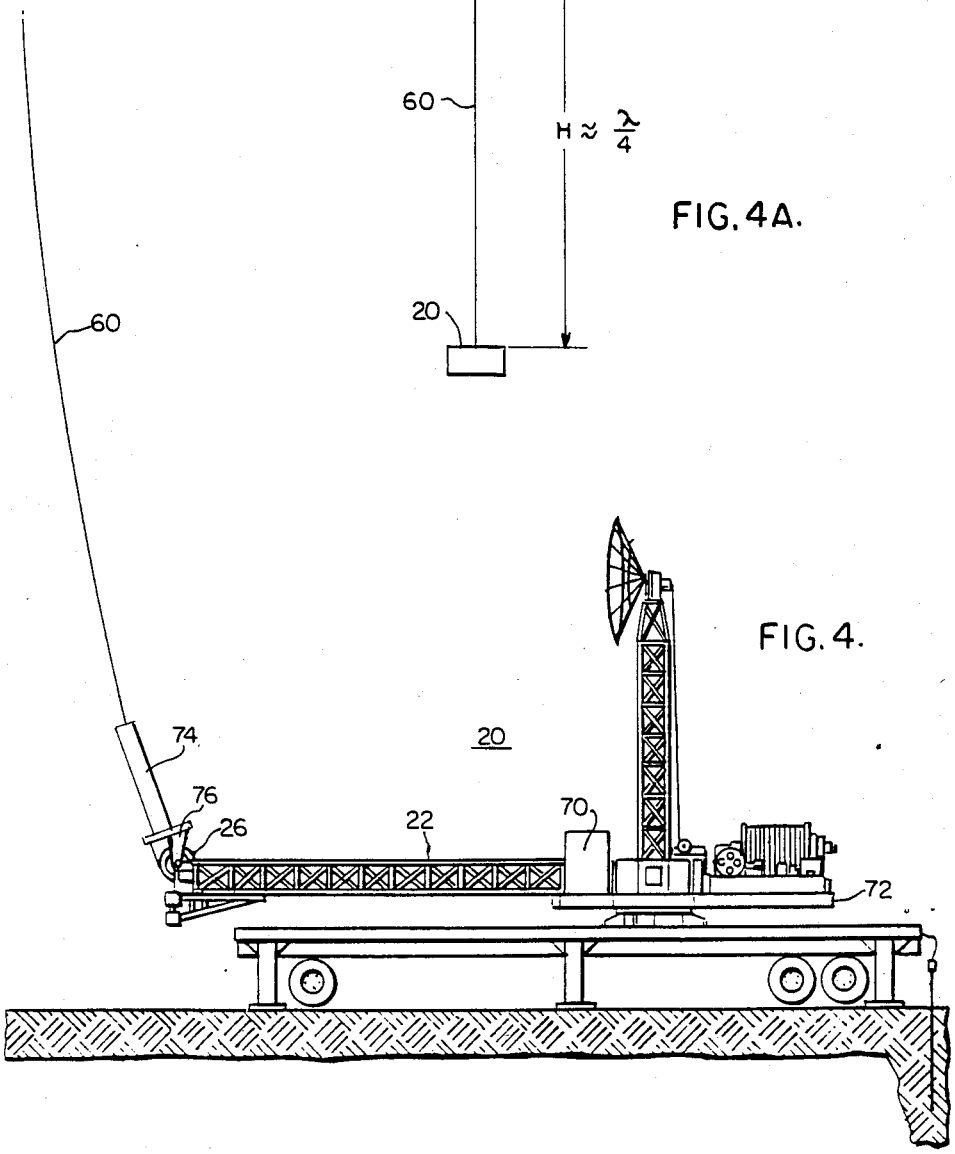
FIG. 4 illustrates one embodiment of the present invention in conjunction with a more detailed view of the mooring system illustrated in FIG. 1.

FIG. 4 shows one embodiment of the present invention wherein the VLF communication system is illustrated in conjunction with the mooring system 20 normally used for conventional aerostat operations and with the preferred tether 60. For purposes of illustration, the VLF transmitter 70 is illustrated on rotatable platform 72 of the mooring apparatus. The VLF communication system includes an elongated sleeve transformer 74 which, in the embodiment of FIG. 4, is positioned above the sheave 26 and carried by a support 76 connected to the sheave.

In the operation of the present invention, and as illustrated in FIG. 4A, the aerostat is deployed at an altitude H such that the tether length is approximately a quarter wavelength of the transmitter operating frequency. Such approximation may be in the order of 90–95% of the quarter wavelength value. Under such operating conditions, the antenna is at or is near resonance and the requirement for a massive tuning inductor is eliminated, as is the requirement for a high operating driving voltage. For example, with the arrangement of FIG. 2, the driving voltage required is in the order of sixty kilovolts RMS at 25 kW whereas in the present invention, the antenna base voltage is much lower and in the order of 1 kilovolt at 25 kilowatts.

Figure 5:
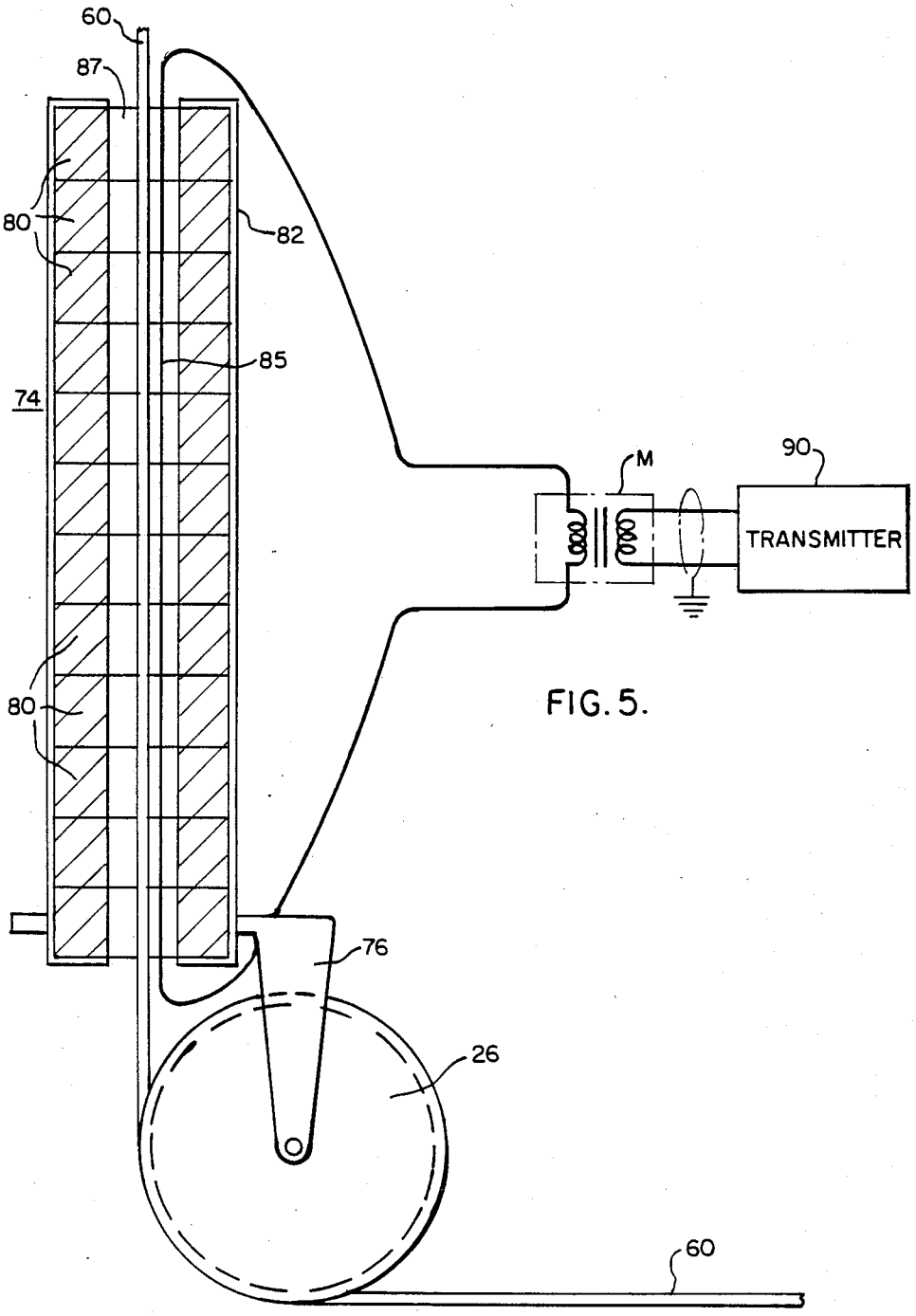
FIG. 5 is a more detailed view of the embodiment of FIG. 4 and further illustrates the transmitter connection.

A more detailed view, including the electrical connections, is shown in FIG. 5 wherein the sleeve transformer 74 is illustrated in an axial cross-sectional view. The transformer 74 surrounds the tether 60 and may be comprised of a plurality of ferrite cores 80 stacked and held in alignment by means of a non-magnetic cradle 82 such as of fiberglass.

The transformer 74 includes a primary winding 85 illustrated as a one-turn primary, which passes through the central aperture 87 of transformer 74, with the tether 60 passing through the central aperture constituting the secondary winding of the transformer. The VLF transmitter 90 is electrically coupled to the primary winding 85, with the coupling including a matching transformer M. This small transformer accommodates for slight impedance mismatches between the output of the transmitter 90 and the base of the antenna constituted by the tether 60 which, by transformer action, has induced therein the VLF signal to be transmitted.

Depending upon the operating frequency, the lower the frequency utilized, the longer will be the core length of the sleeve transformer 74. If the length of the transformer 74 is unwieldy for mounting above the sheave 26, an arrangement such as illustrated in FIG. 6 may be provided.

Figure 6:
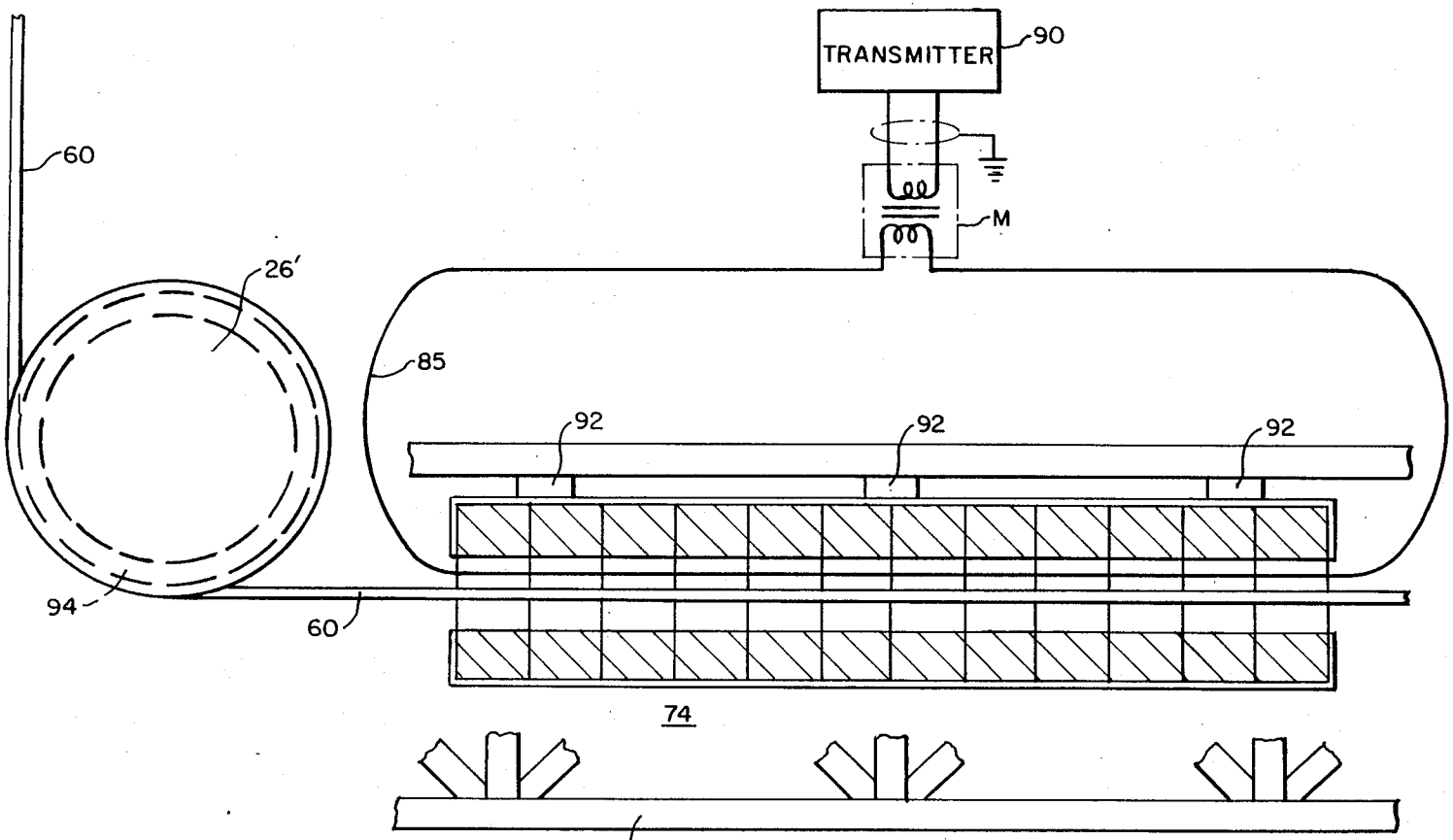
FIG. 6 illustrates another embodiment of the present invention.

In FIG. 6, the transformer 74 is positioned before the sheave and by way of example, may be mounted in the boom structure 22 by connection to a support mechanism 92. The sheave, designated by the numeral 26' is somewhat different than the sheave 26 described in FIG. 5. In view of the fact that a voltage (e.g., 1000 volts) is induced in the tether prior to the sheave, it is necessary to provide electrical insulation between the tether and the sheave. This may be accomplished with the provision of a dielectric insert 94 in the sheave groove and being of sufficient thickness to prevent arcing between the tether 60 and the sheave which is normally at ground potential. Alternatively, such dielectric insert may be eliminated if the sheave itself is made of high strength non-metallic material.

Although the transformer may be placed before or after the sheave, the arrangement of FIG. 6 avoids having the transformer move with the swinging tether as would be the case with respect to the arrangement of FIG. 5.

The ferrite cores 80 of the transformer 74 may be continuous in which case the tether 60 would be initially threaded through the central aperture 87 of the transformer. Alternatively, the ferrite cores may be split, placed in position around the tether and then clamped together in position to constitute the transformer.

Accordingly, there has been provided an aerostat type of VLF communication system which completely eliminates the need for an objectionably massive inductor and which allows the utilization of a tether normally used in such systems. Normal housekeeping functions for the aerostat may be provided by the central conductors of the cable which requires no modification for use as a VLF antenna.

I claim:

1. A VLF communication system, comprising:

(A) a VLF transmitter;

(B) an aerostat;

(C) a ground based aerostat deployment/retrieval mooring system;

(D) an electromechanical tether having an electrical portion and a mechanical portion connecting said aerostat with said mooring system and being of a length H when said aerostat is deployed, where H is approximately a quarter wavelength of the operating frequency of said transmitter;

(E) an elongated sleeve transformer having a longitudinal central aperture;

(F) said transformer including at least a one turn primary winding passing through said central aperture;

(G) said tether passing through said central aperture and constituting a secondary winding of said transformer;

(H) means coupling said primary winding to said transmitter to couple a VLF signal to be transmitted to the electrical portion of said tether which operates as an antenna to radiate said signal.

2. Apparatus according to claim 1 wherein:

(A) said mooring system includes a winch upon which said tether is wound, and a sheave around which said tether passes, when said aerostat is deployed;

(B) said transformer being positioned above said sheave.

3. Apparatus according to claim 2 which includes:

(A) a support upon which said transformer is mounted;

(B) said support being connected to said sheave.

4. Apparatus according to claim 1 wherein:

(A) said mooring system includes a winch upon which said tether is wound, and a sheave around which said tether passes, when said aerostat is deployed;

(B) said transformer being positioned before said sheave, between said sheave and said winch.

5. Apparatus according to claim 4 wherein:

(A) said mooring system includes a horizontal boom structure;

(B) said sheave being mounted at an end of said boom structure;

(C) said transformer being mounted on said boom structure.

6. Apparatus according to claim 5 wherein:

(A) said transformer is mounted in a horizontal orientation.

7. Apparatus according to claim 1 wherein:

(A) said transformer is formed of a plurality of stacked toroidal cores.

* * * * *